US007037046B2

(12) United States Patent
Fergusson

(10) Patent No.: US 7,037,046 B2
(45) Date of Patent: May 2, 2006

(54) YIELDING STRATA BOLT

(76) Inventor: Jeffrey Robert Fergusson, 78 Cairnes Road, Glenorie NSW 2157 (AU)

( * ) Notice: Subject to any disclaimer, the term of this patent is extended or adjusted under 35 U.S.C. 154(b) by 0 days.

(21) Appl. No.: 10/601,024

(22) Filed: Mar. 8, 2004

(65) Prior Publication Data

US 2004/0136789 A1 Jul. 15, 2004

(51) Int. Cl.
*E21D 20/02* (2006.01)

(52) U.S. Cl. ..... 405/259.5; 405/302.2

(58) Field of Classification Search ..... 405/302.2, 405/259.6, 259.5, 259.1
See application file for complete search history.

(56) References Cited

U.S. PATENT DOCUMENTS

| | | | | |
|---|---|---|---|---|
| 3,304,829 A | | 2/1967 | Raynovich, Jr. | |
| 3,978,674 A | | 9/1976 | Herbst | |
| 4,305,687 A | | 12/1981 | Parker | |
| 4,360,292 A | * | 11/1982 | Keeler et al. | 405/259.5 |
| 4,798,501 A | * | 1/1989 | Spies | 405/259.5 |
| 5,233,730 A | * | 8/1993 | Milne et al. | 403/314 |
| 5,586,839 A | * | 12/1996 | Gillespie | 405/259.1 |
| 5,624,212 A | * | 4/1997 | Gillespie | 405/302.2 |
| 5,785,463 A | * | 7/1998 | Eaton et al. | 405/302.2 |
| 5,954,455 A | * | 9/1999 | Eaton et al. | 405/259.6 |
| 6,074,134 A | * | 6/2000 | Stankus et al. | 405/259.6 |
| 6,402,433 B1 | * | 6/2002 | Gillespie | 405/259.1 |
| 6,527,482 B1 | * | 3/2003 | Stankus | 405/259.5 |
| 2004/0136789 A1 | | 7/2004 | Fergusson | |

FOREIGN PATENT DOCUMENTS

WO 2004/001192 * 12/2003

* cited by examiner

*Primary Examiner*—Frederick L. Lagman
(74) *Attorney, Agent, or Firm*—Bell, Boyd & Lloyd LLC

(57) ABSTRACT

The present invention discloses a rock bolt having a tendon (1, 201) which is able to yield and thereby control movement of unstable rock strata into which the bolt is installed. The tendon has a portion which is provided with a grout slippage mechanism, preferably in the form of a tube (8) which surrounds the tendon. A two part grout anchor (10, 100, 200) is clamped to the tendon. The grout anchor is embedded in grout and is therefore essentially immovable. The tendon passing through the anchor is worked and thereby dissipates energy. The tendon can be either a multi-strand cable (1) or a solid bar (200). Various forms of anchor (10, 200) are disclosed with either complementary recess(es) (14) and protrusion(s) (15) or opposed protrusions (115) which form pinch point(s). A one piece grout anchor (300) is also disclosed.

44 Claims, 7 Drawing Sheets

YIELDING STRATA BOLT

FIELD OF THE INVENTION

The present invention relates to strata bolts and, in particular, to a yielding strata bolt intended to control the movement of unstable rock strata into which the bolt is installed. The tendon of the bolt can either be a solid rod or a flexible cable.

BACKGROUND ART

Rock strata are liable to move as a result of various developments including mine-induced seismicity, the excavation of perimeter rock, minor earthquakes, and the like. Some such movements are termed "rock bursts".

In general, regular rock bolts are insufficient to withstand such movement and snap. In the past various proposals have been made. One such proposal is the so called DURABAR or DURABOLT (South African Patent No. 94/2177) invented by D Ortlepp which provides a heavy solid steel bar with a wiggle-like deformation. The bar is grouted in place at installation. As a consequence, in the event of ground movement, the deformed portion of the bar pulls through the grout and this absorbs a considerable amount of energy.

A similar arrangement is to shape the far end of the bar into a conical form which is embedded in grout. The shank of the bar is coated with wax which means that this part of the bar does not bond with the grout. In the event of excessive forces being applied to the bar, the conical end is forced or pulled through the grout. Again this absorbs a considerable amount of energy.

An alternative arrangement is to insert a mild steel slug within a multi-strand steel cable. A tapered sleeve is then placed over the cable. In the event of rock movement, the intention is to extrude the slug through the cable wires which are held in place by the tapered sleeve thereby giving a high pull through force and absorbing a considerable amount of energy. This arrangement is difficult to use in such a way as to give reproducible results and is time consuming to assemble.

OBJECT OF THE INVENTION

The object of the present invention is to provide a yielding cable bolt which is easy to fabricate and assemble and which provides a substantially predictable and repeatable result.

SUMMARY OF THE INVENTION

According to a first aspect of the present invention there is disclosed a yielding grouted rock bolt to control the movement of unstable rock strata into which the bolt is installed, said bolt comprising an elongate tendon, a portion of said tendon having a grout slippage means, and a grout engaging anchor fitted to said tendon portion and thereby at least partially deforming same, whereby in yielding said tendon portion passes through said anchor and is worked thereby.

In accordance with a second aspect of the present invention there is disclosed a two part rock bolt anchor adapted to be fitted to a tendon of a rock bolt, said anchor comprising a body engageable with grout into which said bolt is embedded, and having two parts shaped to be clamped together over said tendon.

In accordance with a third aspect of the present invention there is disclosed a method of permitting a grouted rock bolt having a tendon to yield to control the movement of unstable rock strata into which the bolt is installed, said method comprising the steps of:

(i) providing a portion of said tendon with grout slippage means;

(ii) fitting at least one grout engaging anchor to said tendon and thereby at least partially deforming same;

(iii) installing said rock bolt in a blind hole drilled in said rock strata;

(iv) introducing flowing hardenable grout into said hole to surround said bolt tendon and said anchor(s); and permitting said tendon portion to move through said grout but be worked by movement of said portion through said anchor(s) which is/are substantially immobilized in said grout.

BRIEF DESCRIPTION OF THE DRAWINGS

Embodiments of the present invention will now be described with reference to the drawings in which.

DETAILED DESCRIPTION

Figure 1:
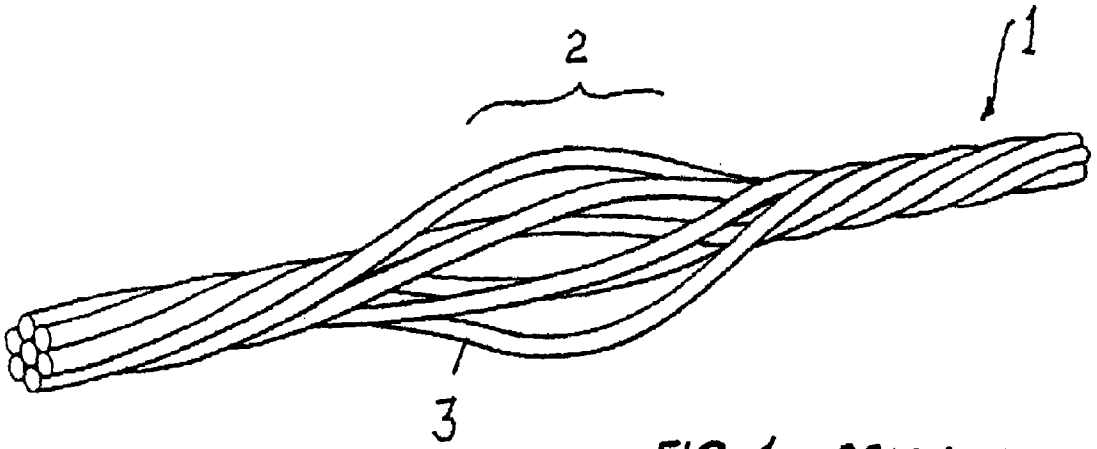
FIG. 1 PRIOR ART
FIG. 1 is a perspective view of a bulge portion of a prior art multi-strand steel cable.

Cable bolts are traditionally made from multi-strand steel cable 1 such as that illustrated in FIG. 1. The cable is conveniently bulged at 2 in known fashion by gripping the cable 1 at two spaced apart locations and forcing the gripped regions together to permanently spring out, or bulge, the strands 3.

Figure 2:
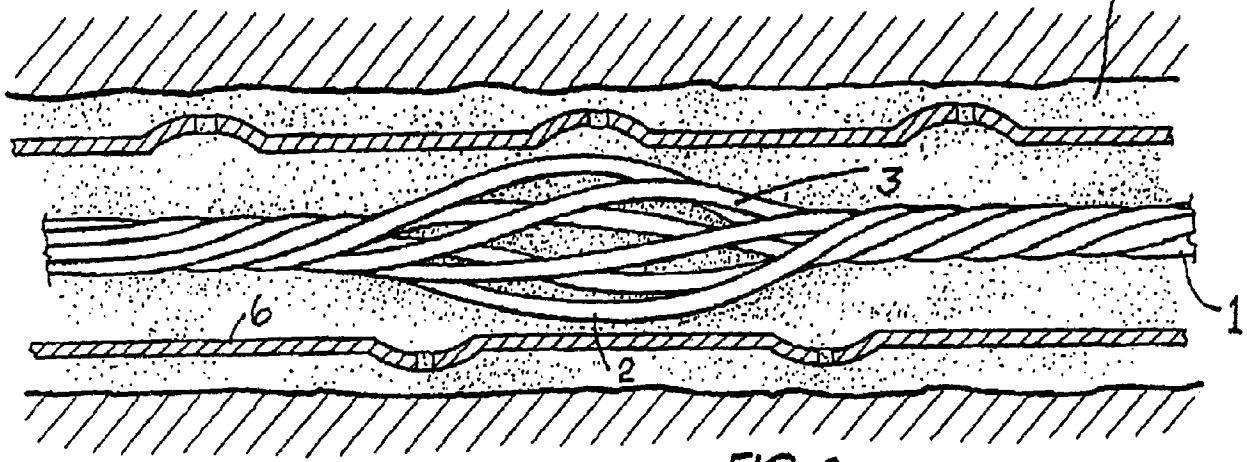
FIG. 2 PRIOR ART
FIG. 2 is a longitudinal view, partly in section, of the cable portion of FIG. 1 installed as a rockbolt.
Figure 3:
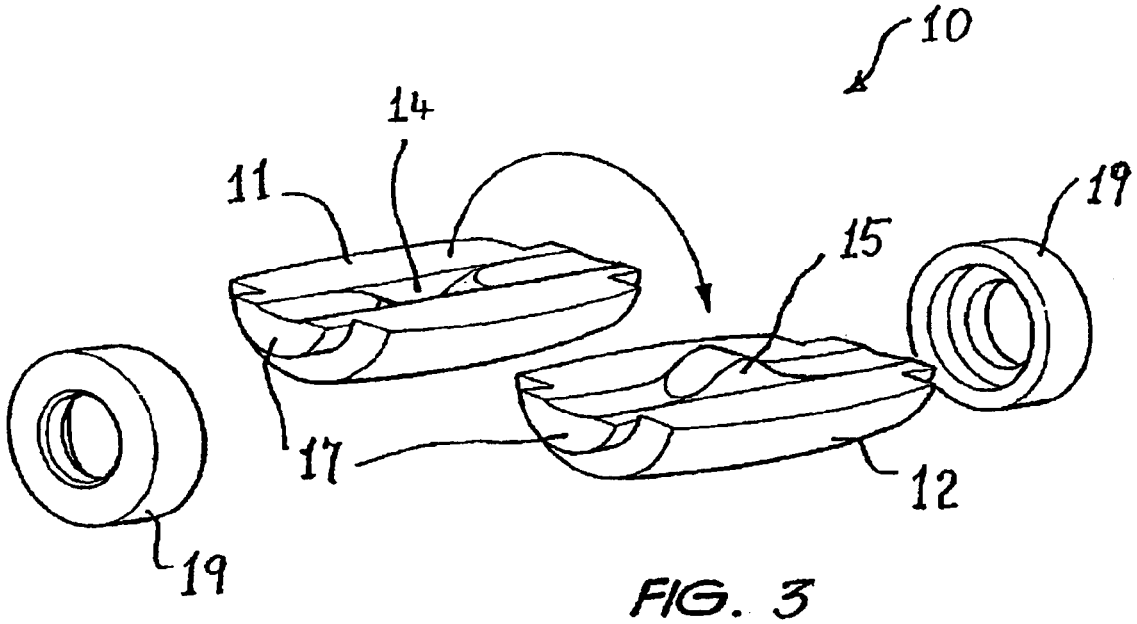
FIG. 3 is an exploded perspective view of a grout engaging anchor.
Figure 6:
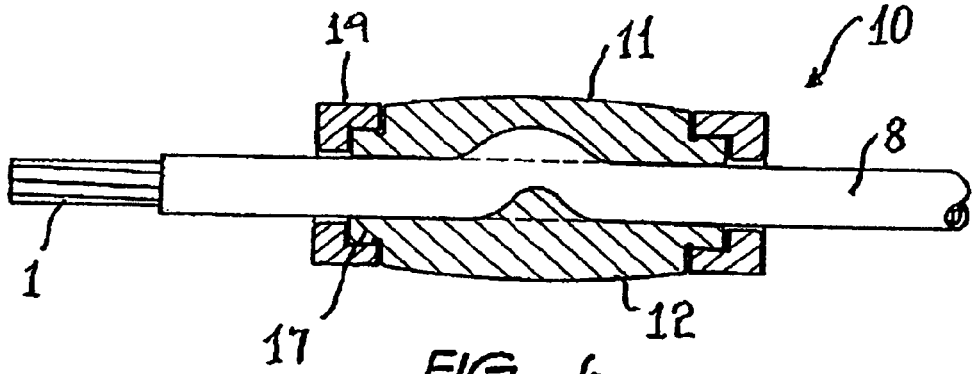
FIG. 6 is a longitudinal sectional view through the assembled anchor of FIG. 5.

As illustrated in FIG. 2, the intention of such a bulge 3 is to enable grout 5 which is normally used to surround the cable 1, to better the grip the cable 1 and so provide good keying between the cable 1 and the grout 5. Such grout 5 is often installed by means of a tube 6 of inexpensive plastics material through which the cable 1 passes. An alternative to bolts with a cable tendon are bolts with a solid tendon. One such bolt is described in Australian Patent No. 669,393 (WO 94/05900) and known as the "CT" bolt.

Turning now to FIGS. 3 to 6, a grout engaging anchor 10 is proposed which is fabricated from two complimentary shells 111 and 12, each of which forms half of the anchor 10. The shell 11 is provided with a single recess 14 whilst the shell 12 is provided with a single protrusion 15. The recess 14 and protrusion 15 are of complimentary shape. In addition, each shell 11 and 12 is provided with a half boss 17 at each end.

Figure 4:
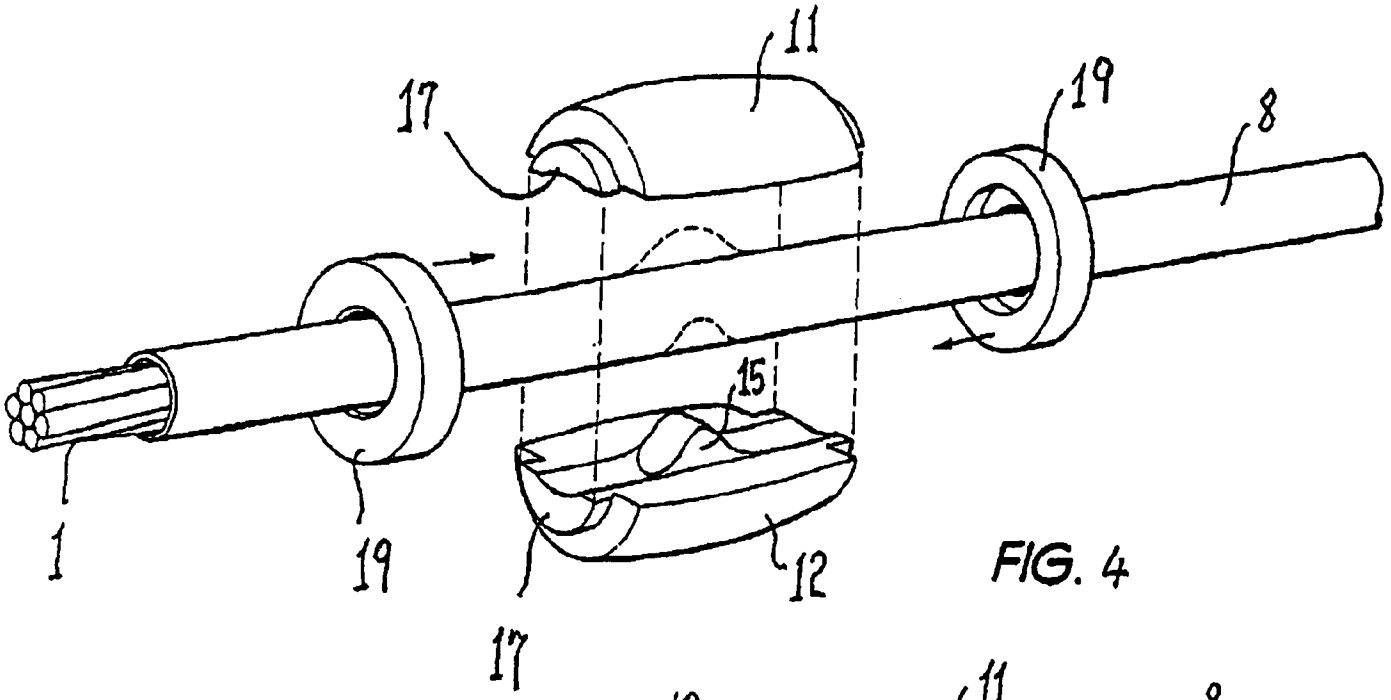
FIG. 4 is an exploded perspective view of the anchor of FIG. 3 during assembly onto a portion of a cable.
Figure 5:
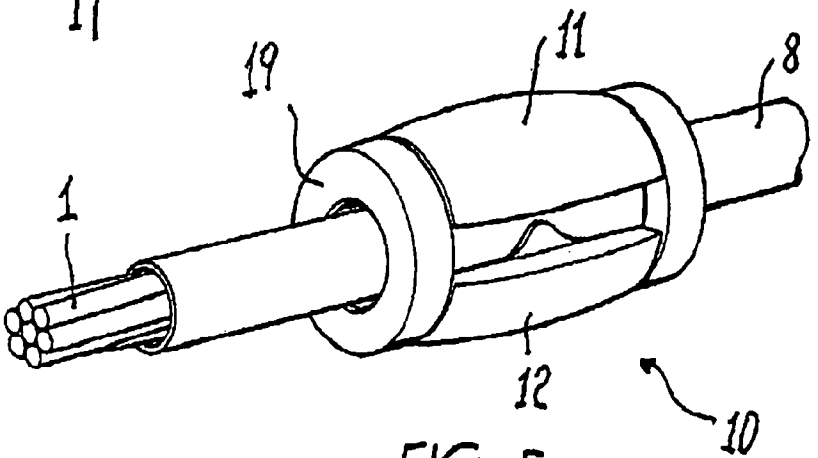
FIG. 5 is a perspective view showing the assembled grout engaging anchor.

As indicated in FIG. 4, the anchor 10 is assembled by passing the cable 1 through a close fitting tube 8 of inexpensive plastics material. The tube 8 is preferably manufactured from high density polyethylene (HDPE) and is widely used for irrigation purposes. The two shells 11 and 12 are then positioned as indicated in FIG. 4 and clamped together so as to securely grip the cable 1 within the anchor 10. With the two shells 11 and 12 clamped together, a keeper ring 19 is passed over the two adjacent half bosses 17 at each end of the anchor 10. With both keeper rings 19 in place, the clamping force on the anchor 10 can be released since the half bosses 17 are then maintained within the keeper rings 19. This is the situation illustrated in FIGS. 5 and 6.

Figure 7:
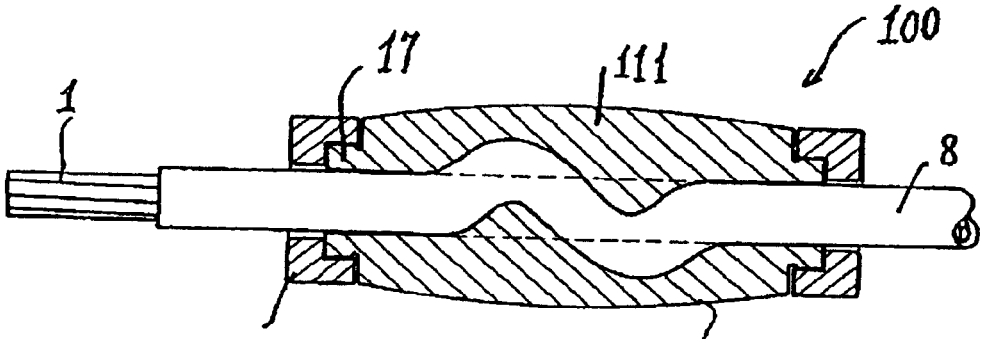
FIG. 7 is a view similar to FIG. 6 but of a second embodiment but of the anchor of FIGS. 3 to 6.

FIG. 7 illustrates a second embodiment of the anchor 100 in which the keeper rings 19 are as before but each of the shells 111 and 112 is provided with a recess 114 and a protrusion 115. As will become apparent hereafter, the purpose of the anchor 100 of FIG. 7 is to provide a greater degree of work before the cable 1 can be passed therethrough.

Figure 8:
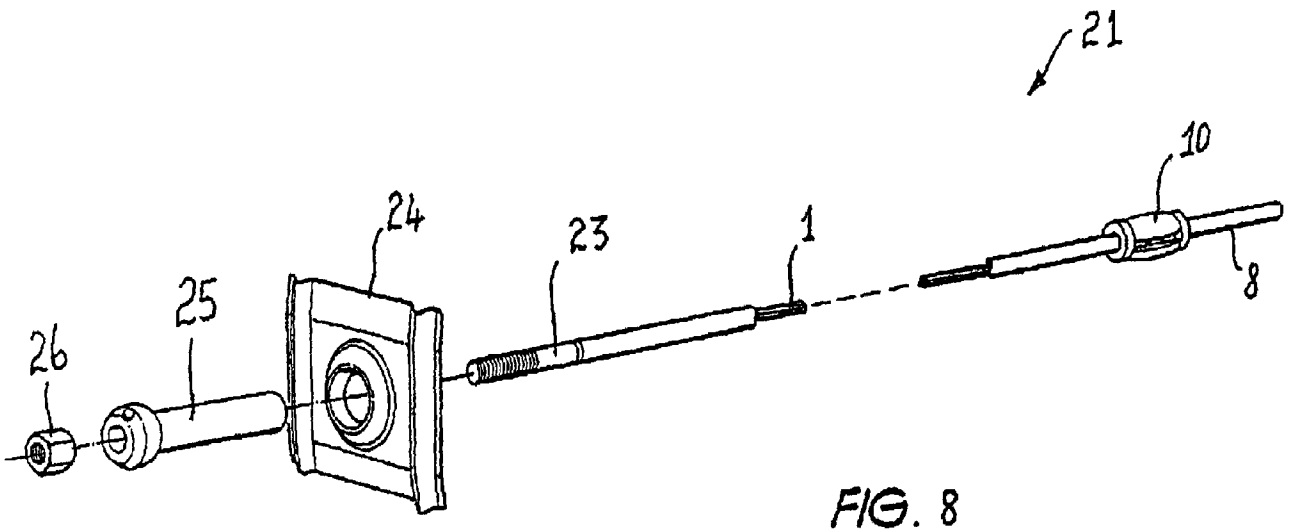
FIG. 8 is an exploded perspective view illustrating a yielding cable bolt in accordance with a first embodiment of the present invention.

Turning now to FIG. 8, a first embodiment of a yielding cable bolt 21 is illustrated. The tendon 22 of the bolt 21 is fabricated from the multi-strand steel cable 1 and the near end is provided with the threaded end fitting 23 which cooperates with a load plate 24, grout injector 25 and nut 26. The grout injector 25 works in the general manner described in the abovementioned Australian Patent No. 669,393 (WO 94/05900). In the embodiment illustrated in FIG. 8, a single anchor 10 is secured adjacent the free end of the bolt 21, however, in the embodiment illustrated in FIG. 9 a pair of spaced apart anchors 10 are so secured.

Figure 9:
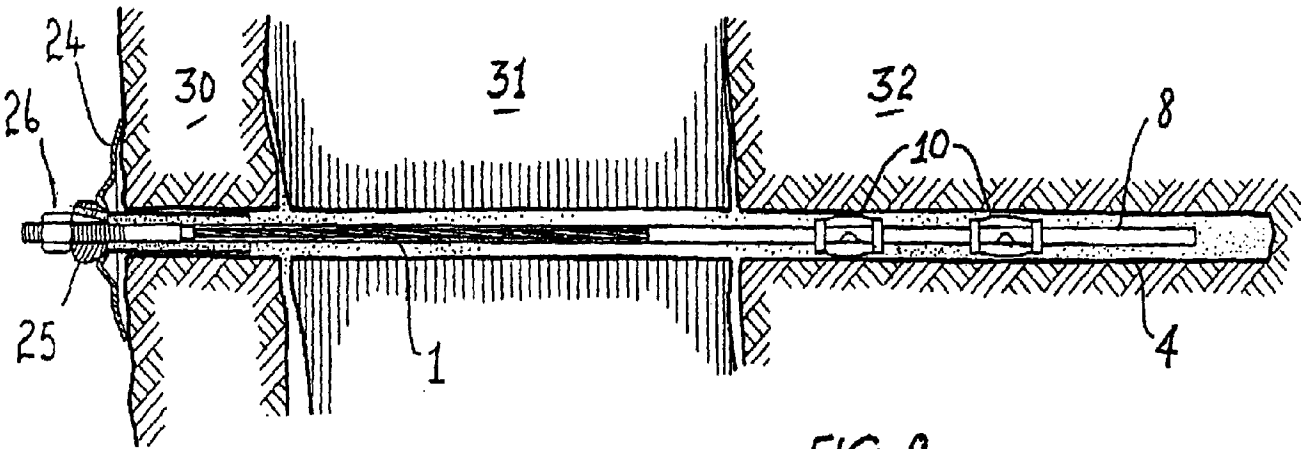
FIG. 9 is a longitudinal view, partly in section, illustrating the bolt of the type shown in FIG. 8 after installation.

In the particular embodiment illustrated in FIG. 9, three strata 30, 31 and 32 are illustrated and strata 30 and 32 are relatively strong whereas stratum 31 is relatively weak and liable to movement. The tube 8 covers the cable 1 essentially throughout the stratum 32 but does not cover the cable 1 essentially throughout the strata 30 and 31. As a consequence, there is good keying between the cable 1 and the grout 5 in the area of strata 30 and 31 but the far end of the cable bolt 21 is itself able to move relative to the grout 5 if necessary, notwithstanding that the two anchors 10 are securely fixed within the grout 5 within the stratum 32.

As a consequence, in the event that strata 30 and 31, for example, move to the left as seen in FIG. 9, the cable 1 at the near end of the cable bolt 21 will move with the strata 30 and 31 due to the keying between the cable 1 and the grout 5. However at the far end of the cable bolt 21 the cable 1 covered by tube 8 is free to move relative to the grout 5 but the grout anchors 10 remain firmly secured relative to the grout 5. As a consequence, the cable 1 is plastically deformed by the anchors 10 as the cable 1 moves past the interengaged recesses 14 and protrusions 15.

As a result, considerable mechanical work is performed in moving the far end of the cable bolt 21 through the anchors 10. In this way, a considerable amount of energy is able to be rapidly dissipated thereby ensuring that the cable bolt 21 yields and absorbs the energy, but does not break.

Figure 10:
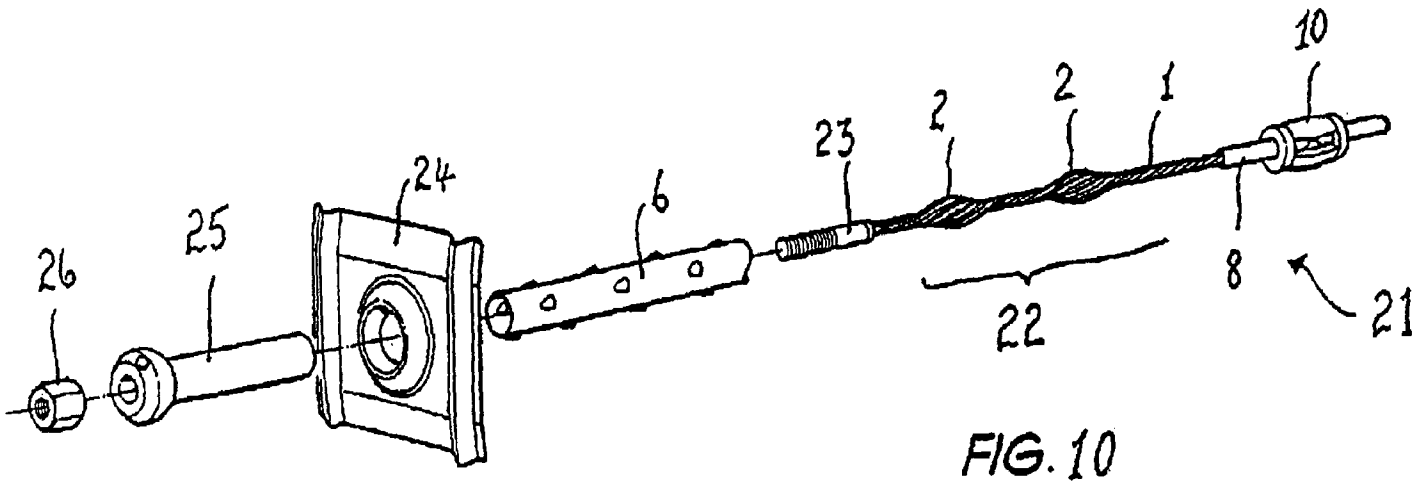
FIG. 10 is a view similar to FIG. 8 but illustrating a yielding cable bolt of a second embodiment.
Figure 11:
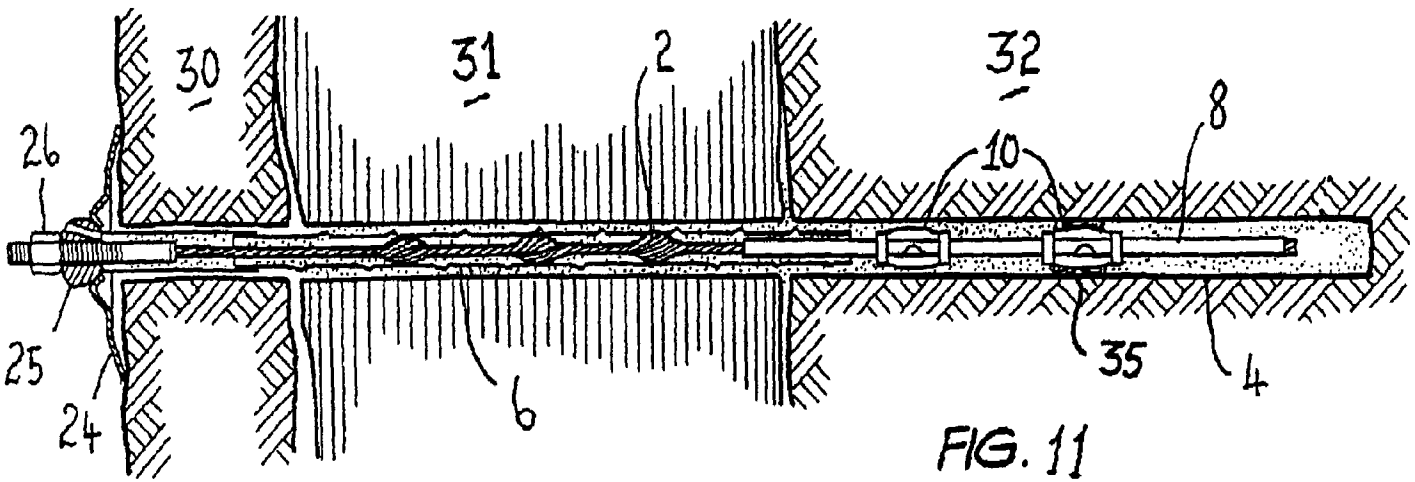
FIG. 11 is a view similar to FIG. 9 but of a cable bolt of the type shown in FIG. 10.
Figure 12:
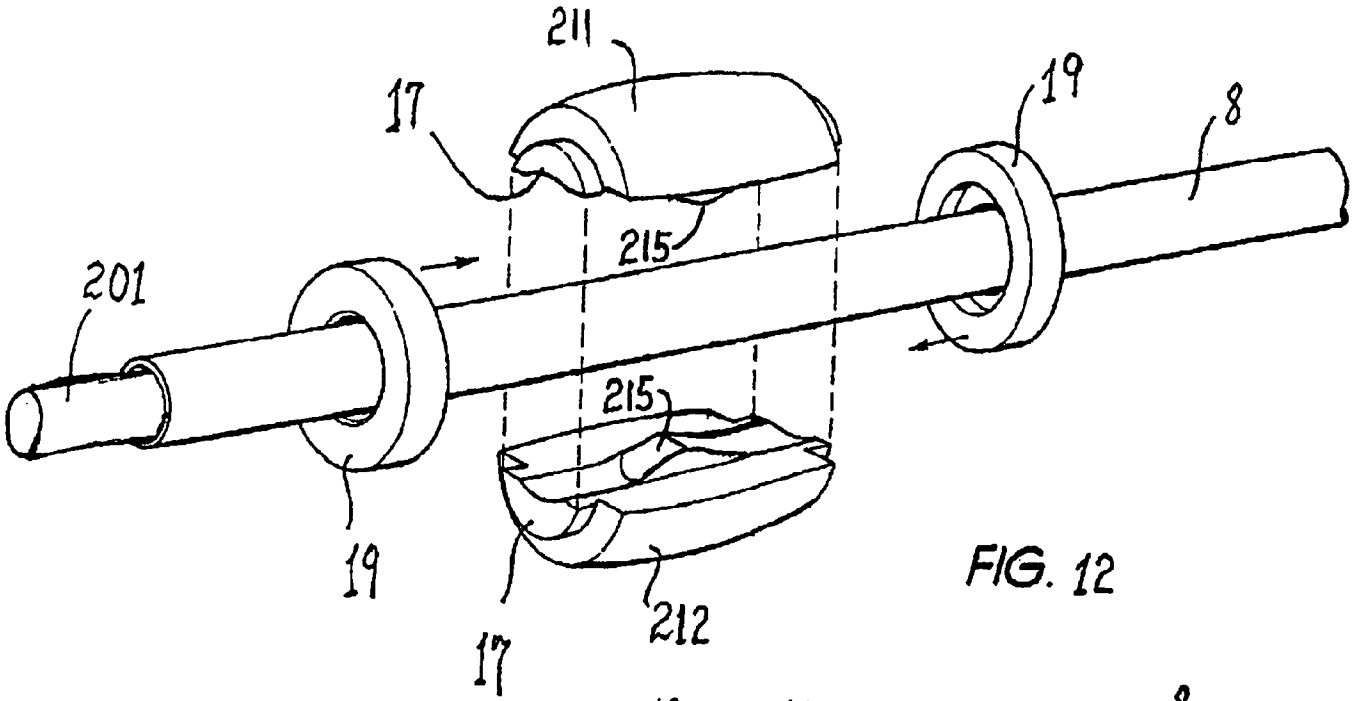
FIGS. 12 and 13 are views similar to FIGS. 4 and 5 respectively but of a still further embodiment of the anchor and bolt.
Figure 13:
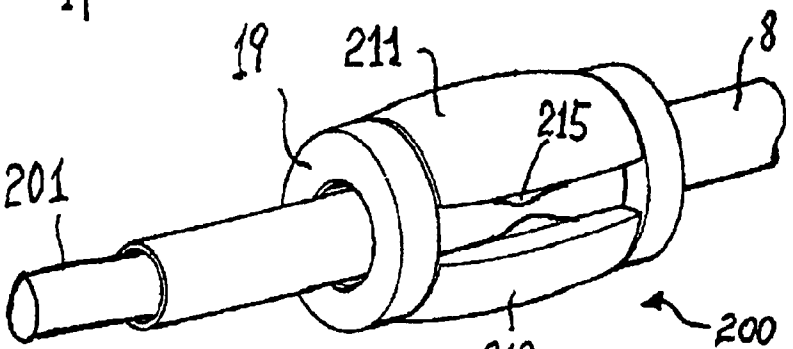
Figure 14:
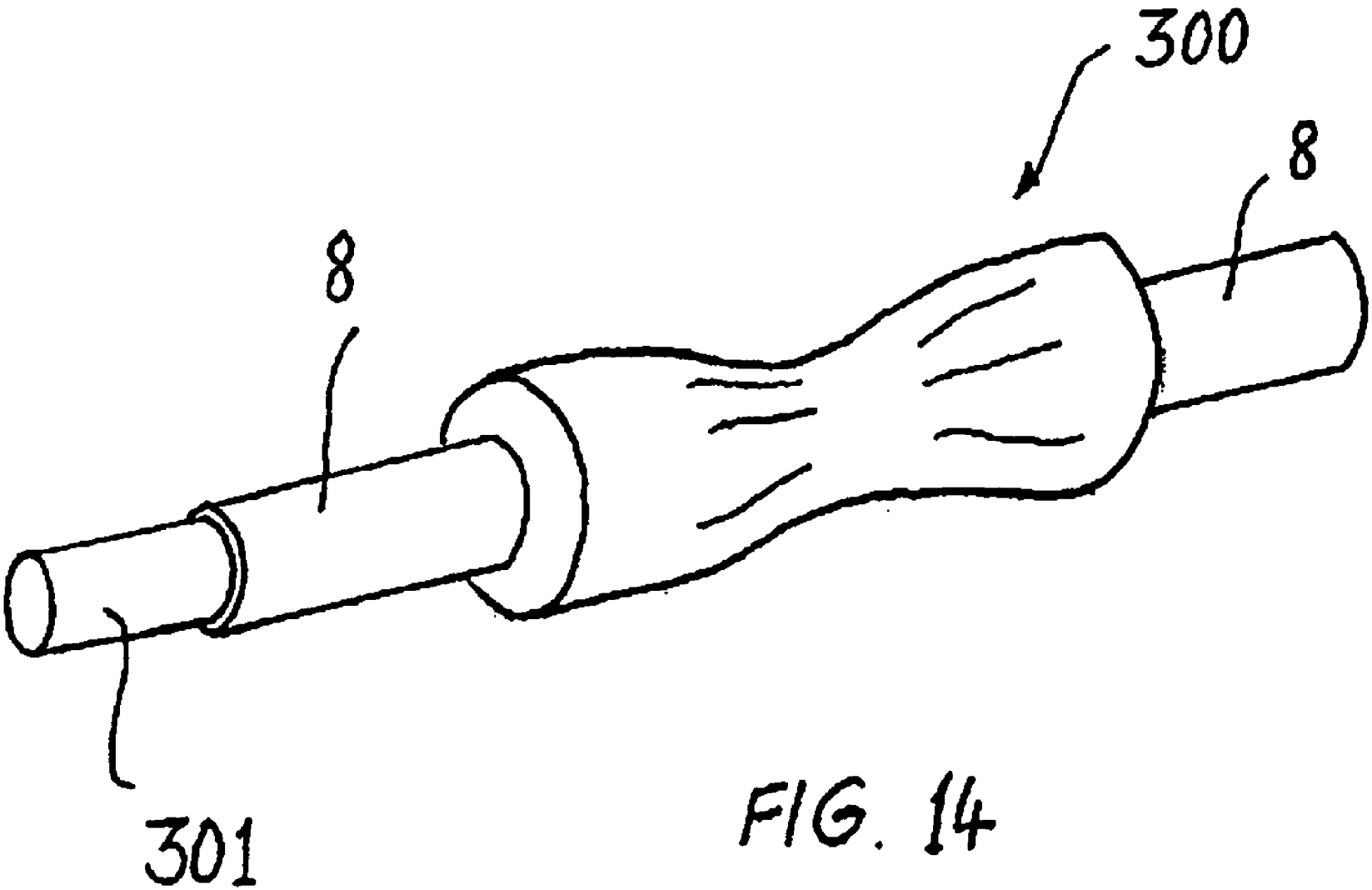
FIG. 14 is a perspective view of yet another embodiment of a grout engaging anchor.

FIGS. 10 and 11 illustrate a second embodiment which is essentially as before save that prior art tube 6 is provided adjacent the near end of the cable bolt 21 and the far end of the cable bolt 21 is provided with an expansion anchor 35 which is formed as part of the anchor 10, or anchor 10 closer(est) to the far tip of the cable. The expansion anchor 35 enables installation of the bolt so as to permit post tensioning deforms the tendon 301 thereby creating a pinch point When a sufficient tensile load is applied to the tendon 301, the tendon 301 pulls through the anchor 300 and is plastically deformed thereby dissipating energy. The deformed anchor 300 remains fixed in the surrounding grout (not illustrated in FIG. 14). If desired, the anchor 300 can be deformed at a number of longitudinally spaced apart locations thereby forming a series of pinch points which are preferably of increasing severity moving away from the far end of the bolt.

The foregoing describes only some embodiments of the present invention and modifications, obvious to those skilled in the art, can be made thereto without departing from the scope of the present invention.

The term "comprising" and its grammatical variations as used herein are used in the sense of "including" or "having" and not in the exclusive sense of "consisting only of".

I claim:

1. A yielding grouted rock bolt to control the movement of unstable rock strata into which the bolt is installed, said bolt comprising a yieldable, elongate tendon, a portion of said tendon having a grout slippage means, and a substantially immovable grout engaging anchor fitted to said tendon portion and thereby at least partially deforming same, whereby in yielding said tendon portion slips relative to said grout slippage means and passes through said anchor and is worked thereby.

2. The bolt as claimed in claim 1 wherein said grout slippage means comprises a tube surrounding said tendon portion.

3. The bolt as claimed in claim 2 wherein said tendon is formed from metal and said tube from plastics.

4. The bolt as claimed in claim 1 wherein said anchor comprises a body engageable with said grout and formed in two parts which are clamped together over said tendon portion to fit said anchor thereto.

5. The bolt as claimed in claim 4 wherein said parts include at least one complementary protrusion and recess.

6. The bolt as claimed in claim 5 wherein said parts include a plurality of complementary protrusions and recesses.

7. The bolt as claimed in claim 4 wherein said parts include at least one pair of opposed protrusions forming a corresponding pinch point.

8. The bolt as claimed in claim 4 wherein said two parts are substantially identical.

9. The bolt as claimed in claim 4 wherein said parts are maintained clamped together by keeper rings shaped to mate with said parts.

10. The bolt as claimed in claim 1 wherein said tendon comprises a multi-strand cable.

11. The bolt as claimed in claim 1 wherein said tendon comprises a bar.

12. The bolt as claimed in claim 1 and having a plurality of said grout engaging anchors.

13. A substantially immovable two part rock bolt anchor adapted to be fitted to a yieldable tendon of a rock bolt, said anchor comprising a body having an exterior engageable with grout into which said bolt is embedded, and having two parts shaped to be clamped together over said tendon to form at least one pinch point through each of which said tendon can only pass by yielding, wherein said parts include at least one complementary protrusion and recess.

14. The anchor as claimed in claim 13 wherein said parts include a plurality of complementary protrusions and recesses.

15. The anchor as claimed in claim 13 wherein said parts are able to be maintained clamped together by keeper rings shaped to mate with said parts.

16. The anchor as claimed in claim 15 wherein said two parts are substantially identical.

17. A method of permitting a grouted rock bolt having a tendon to yield to control the movement of unstable rock strata into which the bolt is installed, said method comprising the steps of:

providing a portion of said tendon with grout slippage means;

fitting at least one grout engaging anchor to said tendon portion and thereby at least partially deforming same;

installing said rock bolt in a blind hole drilled in said rock strata;

introducing flowing hardenable grout into said hole to surround said bolt tendon and said anchor(s); and permitting said tendon portion to move through said grout but be worked by movement of said portion through said anchor(s) which is/are substantially immobilized in said grout.

18. The method as claimed in claim 17 including the further step of forming said tendon as a multi-strand cable.

19. The method as claimed in claim 17 including the further step of forming said tendon as a bar.

20. A substantially immovable rock bolt anchor adapted to be pressed onto a yieldable tendon of a rock bolt, said anchor comprising a body and a tube, said tube having an exterior engageable with grout into which said bolt is embedded and said tube having an interior sized to receive said tendon, wherein said anchor is shaped to be press fitted to said tendon to form at least one pinch point through each of which said tendon can only pass by yielding.

21. The rock anchor as claimed in claim 20 wherein a portion of said tube is crushed to press fit said tube onto said tendon.

22. A yielding grouted rock bolt to control the movement of unstable rock strata into which the bolt is installed, said bolt comprising:

an elongate tendon, a portion of said tendon having a grout slippage means, and a grout engaging anchor fitted to said tendon portion and thereby at least partially deforming same, said anchor including a body engageable with said grout and formed in two parts which are clamped together over said tendon portion to fit said anchor thereto, wherein said parts include at least one complementary protrusion and recess, and wherein in yielding, said tendon portion passes through said anchor and is worked thereby.

23. The bolt as claimed in claim 22 wherein said grout slippage means comprises a tube surrounding said tendon portion.

24. The bolt as claimed in claim 23 wherein said tendon is formed from metal and said tube from plastics.

25. The bolt as claimed in claim 22 wherein said parts include a plurality of complementary protrusions and recesses.

26. The bolt as claimed in claim 22 wherein said parts include at least one pair of opposed protrusions forming a corresponding pinch point.

27. The bolt as claimed in claim 22 wherein said two parts are substantially identical.

28. The bolt as claimed in claim 22 wherein said parts are maintained clamped together by keeper rings shaped to mate with said parts.

29. The bolt as claimed in claim 22 wherein said tendon comprises a multi-strand cable.

30. The bolt as claimed in claim 22 wherein said tendon comprises a bar.

31. The bolt as claimed in claim 22 and having a plurality of said grout engaging anchors.

32. A yielding grouted rock bolt to control the movement of unstable rock strata into which the bolt is installed, said bolt comprising:

an elongate tendon, a portion of said tendon having a grout slippage means, and a grout engaging anchor fitted to said tendon portion and thereby at least partially deforming same, said anchor including a body engageable with said grout and formed in two parts which are clamped together over said tendon portion to fit said anchor thereto, wherein said parts include at least one pair of opposed protrusions forming a corresponding pinch point, and wherein in yielding, said tendon portion passes through said anchor and is worked thereby.

33. The bolt as claimed in claim 32 wherein said grout slippage means comprises a tube surrounding said tendon portion.

34. The bolt as claimed in claim 33 wherein said tendon is formed from metal and said tube from plastics.

35. The bolt as claimed in claim 32 wherein said anchor comprises a body engageable with said grout and formed in two parts which are clamped together over said tendon portion to fit said anchor thereto.

36. The bolt as claimed in claim 32 wherein said parts include at least one complementary protrusion and recess.

37. The bolt as claimed in claim 32 wherein said parts include a plurality of complementary protrusions and recesses.

38. The bolt as claimed in claim 32 wherein said two parts are substantially identical.

39. The bolt as claimed in claim 32 wherein said parts are maintained clamped together by keeper rings shaped to mate with said parts.

40. The bolt as claimed in claim 32 wherein said tendon comprises a multi-strand cable.

41. The bolt as claimed in claim 32 wherein said tendon comprises a bar.

42. The bolt as claimed in claim 32 and having a plurality of said grout engaging anchors.

43. A yielding grouted rock bolt to control the movement of unstable rock strata into which the bolt is installed, said bolt comprising a yieldable, elongate tendon, a portion of said tendon having a grout slippage means, and a substantially immovable grout engaging anchor fitted to said tendon portion and thereby at least partially deforming same, whereby in yielding said tendon portion slips relative to said grout slippage means and passes through said anchor and is worked thereby, wherein said parts include at least one pair of opposed protrusions each forming a corresponding one of said pinch points.

44. A yielding grouted rock bolt to control the movement of unstable rock strata into which the bolt is installed, said bolt comprising a yieldable, elongate tendon, a portion of said tendon having a grout slippage means, and a substantially immovable grout engaging anchor fitted to said tendon portion and thereby at least partially deforming same, whereby in yielding said tendon portion slips relative to said grout slippage means and passes through said anchor and is worked thereby, wherein said parts are able to be maintained clamped together by keeper rings shaped to mate with said parts.

* * * * *